United States Patent [19]

Hodges

[11] 4,275,926

[45] Jun. 30, 1981

[54] DOWN HOLE PUMP WITH BOTTOM RECEPTOR

[76] Inventor: Everett L. Hodges, 49 Royal St. George, Newport Beach, Calif. 92660

[21] Appl. No.: 53,029

[22] Filed: Jun. 28, 1979

[51] Int. Cl.[3] ..... E21B 10/44; E21B 43/28

[52] U.S. Cl. ..... 299/17; 299/8; 299/18; 299/87; 37/62; 175/65; 175/213; 175/215; 175/394

[58] Field of Search ..... 299/17, 7, 8, 9; 175/65, 213, 215, 422; 166/222, 223; 37/62, 63

[56] References Cited

U.S. PATENT DOCUMENTS

| | | | |
|---|---|---|---|
| 2,711,598 | 6/1955 | Craggs, Jr. | 37/62 |
| 3,155,177 | 11/1964 | Fly | 299/17 |
| 3,472,553 | 10/1967 | Miller | 299/5 |
| 3,747,696 | 7/1973 | Wenneborg | 299/17 |
| 3,951,457 | 4/1976 | Redford | 299/17 |

*Primary Examiner*—William F. Pate, III
*Attorney, Agent, or Firm*—Kit M. Stetina

[57] ABSTRACT

A tool for slurrying and recovering minerals, including bitumen, from a single bore hole by hydraulic mining and jet pumping to the surface in which the tool includes conduits for pumping water into a venturi throat, a generally concentric bottom inlet to the venturi throat and a collection device below the venturi for lifting mineral into the venturi. The tool additionally includes means for selectively adjusting the distance between the screw and venturi throat to vary the proportion of suction applied to the bottom and side inlets to the venturi thereby accommodating variations in slurry concentrations and density.

7 Claims, 6 Drawing Figures

DOWN HOLE PUMP WITH BOTTOM RECEPTOR

BACKGROUND OF THE INVENTION

This invention relates to bitumen and mineral recovery by hydraulic mining.

The recovery of minerals by hydraulic mining and jet pumping of agueous mineral slurries is well known. For example, Redford, U.S. Pat. No. 3,951,457, discloses the hydraulic method in which hot water or steam is introduced into a subterranean deposit at high velocity to dislodge bitumen and particles of sand from the surrounding mineral bed. The resulting agueous pulp is pumped to the surface by means of another high velocity jet of hot water or steam. Pfefferle, U.S. Pat. No. 3,439,953, discloses another apparatus for hydraulic mining. The U. S. Department of the Interior, Bureau of Mines, has sponsored development of a tool for single bore hold slurry mining in which a stream of cutting jet water is pumped at very high pressure to a point adjacent the bottom of the bore hole and is directed generally laterally at very high velocity into the surrounding mineral body to dislodge the mineral and form an agueous pulp. The agueous pulp is conveyed to the surface using a jet pump powered by a second stream of high pressure, high velocity water. Additional information on this system is available to the public from Flow Industries, Inc., 21414 68th Ave. South, Kent, Wash. 98031. A pneumatic sampling apparatus in which mineral is sampled and conveyed from below an annular bottom opening is disclosed by Murrell, U.S. Pat. No. 3,807, 541.

Two of the main problems experienced by the prior art liquid systems were obstruction of incoming slurry through clogging of the orifice screens by oversized mineral particles, and slurry input locations which did not provide for simultaneous bottom and suspended slurry recovery. Further, in both the liquid and pneumatic recovery systems, the volume of slurry recovered per unit time was not maximized because of the lack of any means to meter the flow of mined material entering the venturi throat. Thus, significant limitations were imposed upon the efficiency of recovery of the slurry volume.

SUMMARY OF THE INVENTION

The present invention overcomes the problems of the prior art by providing a mining tool which recovers both suspended and bottom slurry through a combination of side and bottom inlets. The slurry is propelled upward through a venturi by forces created in the upward expulsion of fluid from a jet pump located at the extreme lower end of the mining section of the tool. The slurry inlets significantly increase the amount of recoverable bottom slurry through the adjustable clearance or opening of the sleeve positioned around the feed screw which creates a metered flow of slurry at the orifice of the venturi. This metered flow is augmented by controlling the rotational speed of the tool through the surface drive unit, which in combination with the adjustable opening yields a maximum efficiency ratio of solids into the flow stream. The applicant has determined that this maximum efficiency ratio, although dependent upon the particular composition and consistency of the mined material, is typically within the range of 10 to 50 percent solid to liquid, with substantially higher ratios often causing clogging of the orifice screens and lower ratios falling to yield economical material recovery.

The mining tool is comprised of nozzle and mining sections which are registered and fastened together. A cutting jet water supply travels downward through a conduit in the interior cavity of the pipe string and mining tool to an outward directed nozzle which projects the cutting water through an aperture in the outer wall of said mining tool. This action dislodges bitumen and particles of sand from the adjacent bed, creating an agueous pulp or slurry.

Downward flowing jet pump feed water travels through the interior cavity of the pipe string and nozzle section, entering one or more conduits at the top portion of the mining section. These conduits extend downward parallel to the mining section exterior walls to a position below the inlet section of an annular venturi, at which point they bend inward and upward, connecting to the jet pump inlet. The jet pump points upward, directing the feed water in a forceful manner through the inlet section of the annular venturi, and into an annular eductor conduit used for carrying slurry to the surface.

Positioned at the extreme lower end of the mining tool is a screw or mineral recovery device which rotates as the mining tool rotates to raise slurry near the inlet of a frustoconical annular venturi. The slide slurry inlets are also located at this position. The outer sleeve of the screw is preferably selectively adjustable in a vertical axial direction to vary the effective area of the side slurry inlets thereby controlling or proportionately metering the slurry entering the venturi throat through the side and bottom inlets. From this point the venturi force carries the recovered slurry upward and into the eductor conduit for transportation to the surface.

This combination of bottom and side slurry inlets, with the jet pump action directed upward from below the venturi, permit recovery of both bottom and suspended slurry at speeds, volumes, and efficiencies exceeding those of prior art apparatus.

DESCRIPTION OF THE DRAWINGS

These and other features of the present invention will become more apparent upon reference to the drawings wherein.

DETAILED DESCRIPTION OF THE PREFERRED EMBODIMENT

Figure 1:
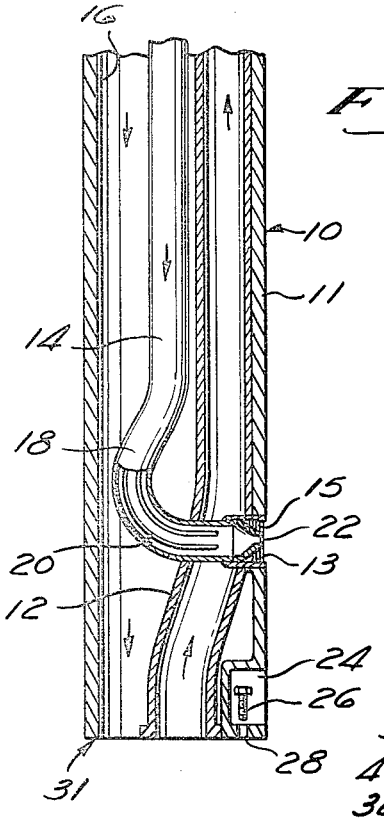
FIG. 1 is an elevational cross-sectional view depicting the internal components of the nozzle section of the mining tool.

Referring to FIG. 1, there is shown the nozzle or column section 10 of the present invention, comprised of an outer casing 11 which is an elongated cylinder of a size convenient for lowering into an existing cylindrical drilling shaft. An eductor conduit 12 extends longitudinally within the cavity of the outer casing 10, and is utilized as a transport means for moving recovered slurry to the surface. A cutting water conduit 14 also extends within the cavity of the outer casing 11 and is utilized for the downward transportation of high pressure cutting jet water for the cutting and slurrying of mined materials. In the lower center of the nozzle section 10, the cutting water conduit 14 turns at bend 18 to interconnect with a cutting jet nozzle 22. Turning vanes 20 are positioned on the interior surface of cutting water conduit 14 at bend 18 to enhance movement of water to the cutting jet nozzle 22. Cutting jet 22 is directed radially outward approximately perpendicular to the side plane of outer casing 10, directing the cutting jet water through an aperture 13 extending through the wall of outer casing 10. In the preferred embodiment, the cutting jet nozzle 22 is formed as an insert which may be sealingly connected to the cutting water conduit 14 and aperture 13 as by way of threads 15. As such, variable orifice size nozzle inserts 22 may be mounted upon the column section 10 to suit the particular composition or consistency of the mineral formations. The remaining interior cavity space 16 of outer casing 10 is utilized for carrying jet pump feed water downward toward the mining section 29 (FIG. 2) of the tool.

Figure 4:
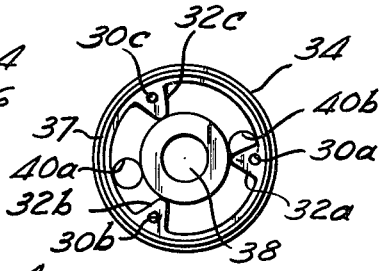
FIG. 4 is a top sectional view taken along lines 4—4 of the mining section of FIG. 2.
Figure 2:
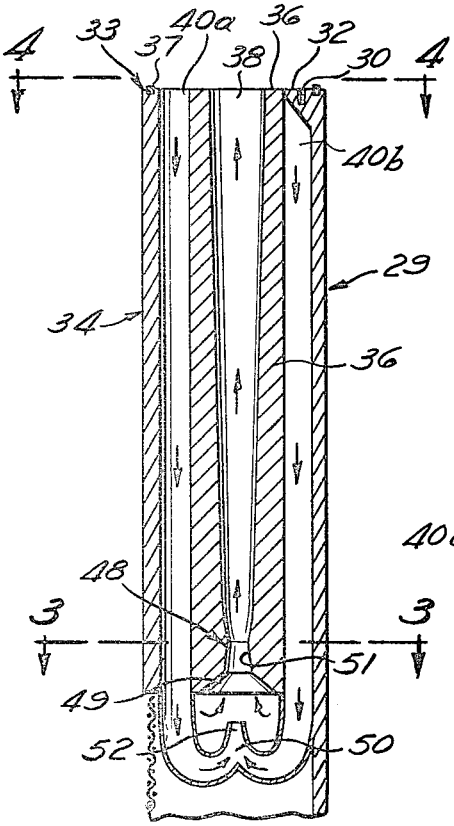
FIG. 2 is an elevational cross-sectional view showing the internal components of the upper portion of the mining section of the mining tool.

The nozzle section 10 of FIG. 1 is registered and attached to the mining section 29 of FIG. 2 along their mutually aligned end surfaces 31 and 33, respectively. A nut and bolt arrangement secures the two sections at preferably three symmetrically positioned locations, as pictured in FIG. 4, wherein 30*a*, 30*b*, and 30*c* represent the three threaded receptor holes into which the corresponding bolts 26 extend. Each nut and bolt arrangement is positioned in a recessed cavity 24 adjacent to the surface of outer casing 10. In each location, a bolt 26 extends downward through an aperture 28 and is secured in position by rotatably interconnecting it with threaded receptor hole 30 of FIG. 2. Receptor hole 30 is positioned within mounting base 32 which provides structural strength to secure the interconnection during forces experienced in normal use. The mounting base location is also indicated in FIG. 4 as 32*a*, 32*b*, and 32*c*. To prevent any leakage between the nozzle and mining sections 10 and 29, respectively, an O-ring seal 37 (shown in FIG. 2) or the like is positioned upon the end surface 33, which seal is compressed during the mounting of the sections by the bolts 26.

Figure 3:
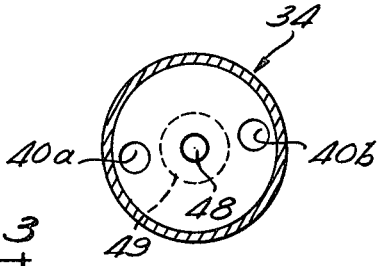
FIG. 3 is a top sectional view of the mining section of the mining tool taken along lines 3—3 of FIG. 2.

Referring to FIGS. 2, 3, and 4, the detailed construction of the mining section 29 of the present invention can be seen. The mining section has an elongated, substantially cylindrical outer casing 34 which is designed for insertion and use in a preexisting cylindrical mining shaft. An annular conduit wall 36 extends axially within the interior cavity of casing 34, and is aligned with and connects at its upper portion to the eductor conduit wall 12 of FIG. 1. The outer surface of annular conduit wall 36 contacts and is held in position by the intermost portion of support members 32*a*, 32*b*, and 32*c* of FIG. 3.

At the extreme lower end of the nozzle section 10 of FIG. 1 is located a diverter (not shown) whereby the downward flowing jet pump feed water contained in cavity 16 is diverted and forced into the open upper ends of conduits 40*a* and 40*b* of FIG. 2. Conduits 40*a* and 40*b* extend adjacent and parallel to conduit wall 36, providing the means whereby feed water is carried downward to an annular jet pump 52. Conduits 40*a* and 40*b* extend to a position below an inlet section 49 of an annular venturi 48, where they bend inward and upward to a connection with a feed water input 50 of an annular jet pump 52. Although, as shown in FIG. 2, the conduits 40 are depicted as being positioned exclusively on two sides of the eductor conduit 12, it will be recognized that the conduits 40 may consist of one or a plurality of separate conduits or one annular conduit extending concentrically about the eductor conduit 12, without departing from the spirit of the present invention.

Near the lower end of eductor conduit 38 the interior wall surface of conduit wall 36 slopes outward to create an annular frusto-conical member whose sides are described by 51. This member comprises the throat of annular venturi 48. At the lower end of said throat surface 51 the interior surface of conduit wall 36 extends downward and outward at an increased angle forming an additional annular frusto-conical member whose sides are described by 49. This member comprises the inlet section of the annular venturi 48.

Figure 6:
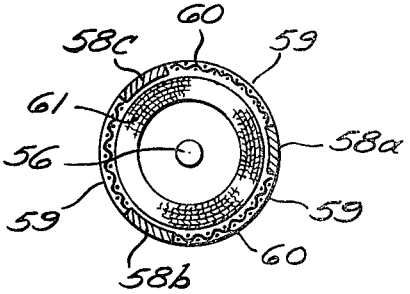
FIG. 5 is an elevational cross-sectional view taken along lines 4—4 of FIG. 2 showing the internal components of the lower portion of the mining section and FIG. 6 is a cross-sectional view taken about lines 6—6 of FIG. 5.
Figure 5:
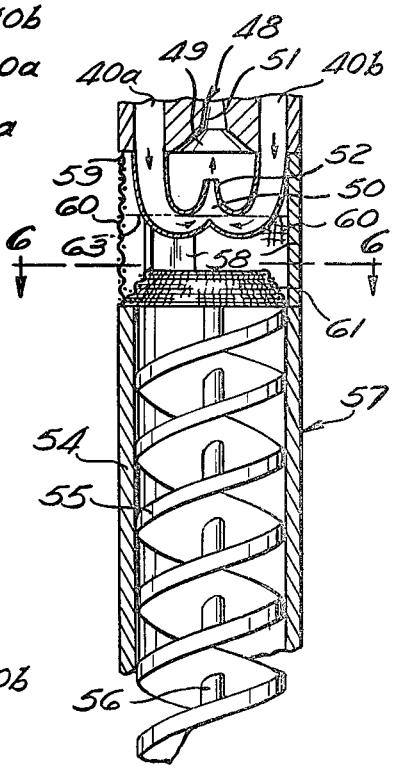

Referring to FIGS. 5 and 6, the detailed construction of the digging portion 57 of the mining section 29 can be seen. The digger portion 57 includes an outer shell 54 which houses a mining screw 55 adapted for rotation about a central shaft 56 to move slurry from the shaft bottom upward toward the slurry inlet mouth 49 of the venturi throat 48. As shown, the upper portion of the shell 54 includes three symmetrically spaced support members or struts 58*a*, 58*b*, and 58*c* which are removably mounted, as by way of mesh fasteners (not shown), to the lower end of the mining section outer casing 34. The openings formed between these struts 58*a*, 58*b*, and 58*c* form the side slurry inlets 59 for the venting throat 48. To prevent any oversized mineral particles from passing into the venturi throat 48 which could clog the venturi, the openings 59 as well as the annular top opening of the shell 54 are each provided with a screen 60 and 61, respectively.

The force created by directing water upward into the annular venturi 48 from the jet pump 52 pulls slurry material upward from the top of the screw 55 through the screen 61 as well as through the side slurry inlets 59 and screens 60 and into the inlet section 49 of the frusto-conical venturi section 48; wherein it is propelled through the venturi throat 51 and upward to the surface through eductor conduit 38 in FIG. 2 and 12 in FIG. 1.

In the preferred embodiment, the effective size of the side opening 59 may be adjusted prior to insertion of the tool into the mine shaft by either the insertion of block segments 63 (represented by the phantom lines in FIG. 5) between the struts 58*a*, 58*b*, or 58*c* or alternatively by forming the casing 54 to selectively reciprocate axially (i.e., telescope) along the length of the struts 58*a*, 58*b*, or 58*c*.

As will be recognized, by varying the effective size of the openings 59, the amount of suction (developed by the venturi 48) sensed at the side and bottom inlets of the casing 54 may be proportionately varied to accommodate differences in slurry concentration and density. As such, the amount of mined material entering the venturi 48 may be metered between the side and bottom inlets to maximize mining efficiency.

It will be apparent to one skilled in the art that the digger portion 47 may be modified such that a crushing apparatus is utilized in place of the screw mechanism 55 of FIG. 5. Such crushing mechanisms are commonly known in the field and are commercially available from a variety of sources. The crushing mechanism would be contained in a housing 54 of FIG. 5 which would be registered and connected to the lower end of the mining section 29 by attachment to the lower end of support members or struts 58*a*, 58*b*, and 58*c* of FIG. 5.

Although a preferred embodiment of the invention has been herein disclosed, it is to be understood that the present disclosure is made by way of example and that variations are possible without departing from the subject matter coming within the scope of the following claims, which subject matter is regarded as the invention.

I claim:

1. An improved hydraulic mining apparatus for the economical recovery of mineral bearing materials from subterranian deposits comprising:

a drill string adapted to rotate within a bore hole extending from ground surface into said subterranian deposit;

a mining tool mounted on one end of said drill string to be disposed within said subterranian deposit;

a hydraulic cutting jet positioned on said mining tool for dislodging said mineral bearing material from said deposit and forming an aqueous mineral bearing slurry;

a hydraulic venturi pump located within the interior of said mining tool for transporting said aqueous mineral bearing slurry through said drill string to ground surface;

a first and second slurry inlet formed on said mining tool for permitting said aqueous mineral bearing slurry to enter into said hydraulic venturi pump, said first inlet positioned to direct said aqueous mineral bearing slurry radially into said venturi pump and said second inlet positioned to direct said aqueous mineral bearing slurry axially into said venturi pump; and means connected to said mining tool for continuously feeding said aqueous mineral bearing slurry upward through said second inlet.

2. The hydraulic mining apparatus of claim 1 wherein said continuous feeding means comprises:

a hollow sleeve mounted at one end to said mining tool and disposed below said venturi pump; and an Archimedes screw mounted within the interior of said sleeve and extending axially beyond the other end of said sleeve, said screw adapted to raise said aqueous mineral bearing slurry along the length of said screw during rotation of said drill string.

3. The hydraulic mining apparatus of claim 2 wherein said first inlet comprises plural openings formed in said hollow sleeve adjacent said one end of said sleeve.

4. The hydraulic mining apparatus of claim 3 wherein the size of said plural openings may be varied to proportionately meter the amount of said aqueous mineral bearing slurry entering through said first and second inlets.

5. An improved hydraulic mining method for economically recovering mineral bearing material from subterranian deposits comprising the steps of:

rotating a hydraulic mining tool within a bore hole extending from ground surface into said subterranian deposit;

introducing hydraulic mining fluid radially outward from said mining tool at a high velocity to dislodge said mineral bearing material from said deposit and form an aqueous mineral bearing slurry;

forming a hydraulic venturi pump within the interior of said mining tool for transporting said aqueous mineral bearing slurry from said subterranian deposit to ground surface;

directing a first portion of said aqueous mineral bearing slurry radially within the interior of said mining tool for entry into said hydraulic venturi pump; and forcibly feeding a second portion of said aqueous mineral bearing slurry axially within the interior of said mining tool along an archimedes screw mounted to said mining tool for entry into said hydraulic venturi pump.

6. The method of claim 5 further comprising the step of varying the relative amount of said first and second portions of said aqueous mineral bearing slurry entering into said hydraulic venturi pump to maximize mining efficiency.

7. An improved hydraulic mining apparatus for the economical recovery of mineral bearing materials from subterranian deposits comprising:

a drill string adapted to rotate within a bore hole extending from ground surface into said subterranian deposit;

a mining tool mounted on one end of said drill string to be disposed within said subterranian deposit;

a hydraulic cutting jet positioned on said mining tool for dislodging said mineral bearing material from said deposit and forming an aqueous mineral slurry;

pump means located within the interior of said mining tool for transporting said aqueous mineral bearing slurry through said drill string to ground surface;

a first and second slurry inlet formed on said mining tool for permitting said aqueous mineral bearing slurry to enter into said pump means, said first inlet positioned to direct said aqueous mineral bearing slurry radially toward said pump means and said second inlet positioned to direct said aqueous mineral bearing slurry axially toward said pump means; and means connected to said mining tool for forcibly feeding said aqueous mineral bearing slurry upward through said second inlet.

* * * * *